United States Patent [19]

Kato et al.

[11] Patent Number: 4,891,047

[45] Date of Patent: Jan. 2, 1990

[54] PROCESS FOR DYEING FIBERS WITH A DYE LIQUOR CONTAINING GRANULES OF SILICA GEL

[76] Inventors: Hrioshi Kato, Abiko; Keiichi Komatsu, Yatabe, both of Japan

[21] Appl. No.: 932,241

[22] Filed: Nov. 19, 1986

[30] Foreign Application Priority Data

Nov. 19, 1985 [JP] Japan ..... 60-257695

[51] Int. Cl.[4] ..... D06P 1/67; D06P 3/14

[52] U.S. Cl. ..... 8/632; 8/543; 8/673; 8/676; 8/680; 8/685; 8/917; 8/918; 8/924

[58] Field of Search ..... 8/632

[56] References Cited

U.S. PATENT DOCUMENTS

| | | | |
|---|---|---|---|
| 3,340,000 | 9/1967 | Shansky | 8/543 |
| 3,416,876 | 12/1968 | Ohmer | 8/632 |
| 3,416,878 | 12/1968 | Biber | 8/632 |
| 3,843,318 | 10/1974 | von der Eltz | 8/632 |
| 3,865,544 | 2/1975 | Keil | 8/581 |
| 3,934,973 | 1/1976 | Shultz et al. | 8/632 |
| 3,984,200 | 10/1976 | Doesburg | 8/581 |
| 3,994,683 | 11/1976 | Zimmer et al. | 8/632 |
| 4,047,887 | 9/1977 | Kackstadter et al. | 8/632 |

FOREIGN PATENT DOCUMENTS

| | | |
|---|---|---|
| 148681 | 7/1985 | European Pat. Off. . |
| 1425237 | 2/1976 | United Kingdom . |
| 2155004 | 9/1985 | United Kingdom . |

OTHER PUBLICATIONS

Chem. Abstracts, vol. 59, No. 12, 1963, 14157h–14158a.

*Primary Examiner*—A. Lionel Clingman
*Attorney, Agent, or Firm*—Armstrong, Nikaido, Marmelstein, Kubovcik & Murray

[57] ABSTRACT

A process for dyeing fibers. Fibers are dyed in a dye liquor containing granules of silica gel.

4 Claims, 2 Drawing Sheets

PROCESS FOR DYEING FIBERS WITH A DYE LIQUOR CONTAINING GRANULES OF SILICA GEL

BACKGROUND OF THE INVENTION

This invention relates to a dyeing process for various kinds of fibers such as silk, wool and the like.

As processes for dyeing various kinds of fibers such as silk, wool and the like, there have hitherto been known, in general, an acid bath dyeing process and a neutral bath dyeing process.

Among the foregoing conventional dyeing processes, the former one, that is, the acid bath dyeing process, is such that the dyeing of the fibers is carried out by ionic bonding, so that the process is high in degree of exhaustion of dyes and is suitable for deep shade dyeing and is excellent in fastness for dyeing. However, the process is disadvantageous in that it is low in leveling property and is liable to result in dyeing specks.

The neutral bath dyeing process is excellent in migration property and accordingly is excellent in leveling property, so that dyeing specks are not a problem. However, the process is inconvenient in that it is low in degree of exhaustion and it is difficult to obtain a deep shade dyeing, and it is poor in fastness for dyeing.

This invention has for an object the providing of a process which does not have the disadvantages described above and to provide a dyeing process for fibers that, even in a neutral bath dyeing process which is excellent in leveling property and does not cause dyeing specks, produces a degree of exhaustion which is higher than that obtained with an acid bath dyeing process and which is suitable for deep shade dyeing and can provide excellent fastness for dyeing such as that obtained in an acid bath dyeing process.

SUMMARY OF THE INVENTION

According to the present invention, a process for dyeing fibers is provided which is characterized by the use of a dyeing liquor containing granules of silica gel.

DESCRIPTION OF PREFERRED EMBODIMENTS

Figure 1:
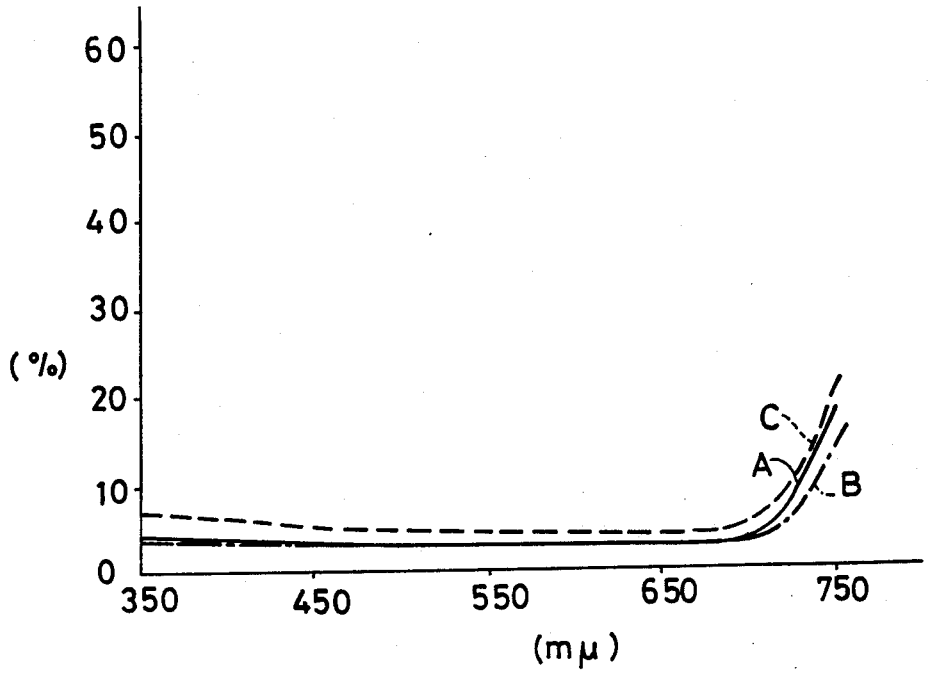
FIG. 1 is a characteristic curve diagram showing reflectivities of silk cloths dyed according to embodying examples of the dyeing process of the present invention and according to a comparison process.

The granules of silica gel useful in this invention have average diameters ranging from about 3–40 μm. The granules are added to a dye liquor in a concentration of about 5–10% by weight in relation to the weight of the fibers.

In order to maintain a good dispersion of the granules of silica gel in the dye liquor, a bath ratio between the fiber and the dye liquor is comparatively large and is about 1:50–1:100, for instance. An ordinary dyeing assistant such as Glauber's salt, sodium acetate, acetic acid, or the like may be added to the dye liquor, as occasion demands.

The concentration of the dye liquor used in the process of the present invention is typically in the range of 5 to 15% OWF.

Other dyeing conditions such as dyeing temperature and dyeing time can be readily determined according to the condition of the object to be dyed, the kind of dye, use of a dyed product, and the like.

As for dyestuffs useful in the dyeing process of the invention, there may be mentioned direct dyes, acid dyes, metal complex dyes, chrome dyes, reactive dyes and the like.

As fibers suitable for being dyed according to the dyeing process of the present invention, there may be mentioned any natural and synthetic fibers including silk, wool, nylon, cotton, rayon, vinylon (polyvinyl alcohol), etc., which can be dyed according to the conventional acid bath and neutral bath dyeing processes.

The reason why degree of exhaustion and color fastness are improved by the addition of the granules of silica gel to the dyeing liquor is presumed to be attributable to a surface electrochemical action of the granules of silica gel from the fact that the granules of silica gel are not absorbed by the fibers. More particularly, it is presumed that color anions dissociated in the dye liquor are attracted to a positively charged layer of water formed on a negatively charged layer of granules of silica gel, that is, to the electrical double layers formed at an interface between water and the granules of silica gel which are dispersed in the dye liquor and negatively charged. Of the attracted color anions those that have been neutralized are bonded to the fibers by such secondary bonding forces as hydrogen bonding force and van der Walls force, and an overwhelming majority of such secondary bonding forces overcomes the electrostatic bonding force, so that the color anions are separated from the granules of silica gel and transfer to the fibers while migrating thereto for dyeing the same. In other words, it can be considered that, by bringing the granules of silica gel and thus attracting the color anions into contact with the fibers, the dye liquor surrounding the fibers is brought into such a condition that the dye molecules contained therein are condensed, so that the same are absorbed on the fibers at a high efficiency.

The dyeing process of the present invention is especially suitable for the neutral bath dyeing process which is low in degree of exhaustion and in color fastness. The process of the invention, however, is not limited thereto, and it is a matter of course that, even in the case of applying the invention to the acid bath dyeing process, there can be achieved an improvement in degree of exhaustion, and accordingly an excellent dyeability.

This invention will be explained in further detail below with reference to concrete embodying examples and comparison examples thereof.

EXPERIMENT 1

There were prepared various embodying samples and comparison samples of dye liquors by using various kinds of dyes listed in the following Table 1 in such a manner that each of the dye liquor samples was made into three types by adding granular silica gel G (granular diameter: 10–40 μm manufactured by German Melk Co.) in an amount of 5% OWF (% by weight in relation to fibers), in an amount of 10% OWF and without the addition of the silica gel. The dye liquor samples thus prepared were used for dyeing pieces of refined silk cloth called "Hira Habutae" with 21 metsuke of about 2 grams each, as embodying examples and comparison examples as explained in detail below. The term "metsuke" represents a unit of thickness of the refined silk cloth.

In the case of dyes other than the reactive dyes, in the embodying examples and comparison examples, the silk cloth was subjected to a dyeing treatment in such a manner that the same was dipped, at a normal temperature, in each dye liquor sample, which was 5% OWF in dye concentration, but was 2% OWF in the case of the dye marked with a symbol * shown in the table and was 1:100 in bath ratio. Thereafter the resultant dye bath was raised in temperature to 85°–95° C. during a period of 40–50 minutes, and this temperature was maintained for 60 minutes.

In the case of the reactive dyes, the silk cloth was subjected to a dyeing treatment so as to be absorbed with the same for 30 minutes in the dye liquor which was 5% OWF in dye concentration and 1:100 in bath ratio, and thereafter a fixing treatment thereof was carried out for 60 minutes by the addition of sodium carbonate in an amount of 1 g/l. Then a soaping treatment was carried out for 20 minutes with an aqueous solution at 80° C. comprising a nonionic surfactant (Neugen HC manufactured by Daiichi Kogyo Seiyaku Kabushiki Kaisha) of 2 g/l.

The dyeing temperature was 35° C. in the case of Mikacion brilliant red 5BS, and was 80° C. in the case of Kayacion navy E-SNG.

The silk cloth after the dyeing treatment was fully washed with hot water of 45°–50° C., and was air dried.

Thereafter, the pH value of the residual bath of each dye liquor, the degree of exhaustion and the surface dyeing concentration in each silk cloth were measured. The degree of exhaustion (%) was calculated from the difference in dye concentration between the dye bath before dyeing and that after dyeing. The surface dyeing concentration (K/S value) was obtained by measuring reflectivity by a self registering spectrophotometer (MPS-50L type by Shimazu Seisakusho), and calculating the same from the Kubelka-Munk equation. There were obtained measured values as indicated in the following Table 1.

TABLE 1

| | | residual bath pH | | | degree of exhaustion % | | | surface dyeing concentration (K/S value) | | |
|---|---|---|---|---|---|---|---|---|---|---|
| | Silica gal G concentration (% OWF) | 0 | 5% | 10% | 0 | 5% | 10% | 0 | 5% | 10% |
| Kind of dye | Name of Dye | | | | | | | | | |
| Direct dye | Kayaku direct special black AXN | 8.0 | 8.7 | 7.8 | 12 | 35 | 69 | 6.0 | 7.7 | 10.1 |
| | Japanol fast Black D conc. | 8.4 | 7.6 | 7.2 | 7 | 20 | 35 | 5.1 | 6.3 | 7.4 |
| | Kayaku direct rhoduline red B | 8.7 | 7.8 | 7.0 | 6 | 12 | 60 | 0.5 | 3.4 | 7.5 |
| Acid dye | Kayanol cyanine G | 8.3 | 7.6 | 6.9 | 19 | 55 | 87 | 6.7 | 8.1 | 8.5 |
| | Kayanol milling black TLB | 8.7 | 8.0 | 7.6 | 10 | 43 | 51 | 2.8 | 6.7 | 9.2 |
| | Kayanol milling black VLG | 8.0 | 7.6 | 7.0 | 12 | 51 | 86 | 3.4 | 6.6 | 7.7 |
| | Kayanol milling cyanine 5R | 8.6 | 7.8 | 7.0 | 8 | 36 | 86 | 1.8 | 5.9 | 8.1 |
| Metal complex dye | Kayalax brown R | 8.4 | 7.4 | 6.9 | 5 | 43 | 82 | 2.4 | 3.4 | 5.0 |
| | Kayakalan black 2RL | 8.1 | 7.6 | 7.1 | 12 | 45 | 75 | 7.4 | 8.5 | 9.4 |
| Chrome dye | Sunchromine blue black R conc. | 8.1 | 7.8 | 7.5 | 18 | 46 | 51 | 1.4 | 3.2 | 9.9 |
| Reactive dye | Mikacion brilliant red 5BS | — | — | — | — | — | — | 2.9 | 4.4 | 5.9 |
| | Kayacion navy E-SNG | — | — | — | 18 | 26 | 32 | 4.5 | 5.5 | 6.2 |
| Basic dye | Rhodamine B | 8.2 | 6.8 | 5.9 | 71 | 74 | 72 | 6.3 | 6.5 | 6.4 |

As will be clear from the Table 1, in all of the cases of the embodying examples wherein the silica gel G was added to the dye liquors, the degree of exhaustion and the surface dyeing concentration were improved in respect of all the dyes and, above all, were remarkably improved in respect of the direct dye, the acid dye and the metal complex dye. The pH value of each dye liquor is hardly influenced by the addition of the silica gel G, and thus the dyeing is a neutral bath dyeing.

Among the dyes used, Japanol fast black D conc. and Sunchromine blue black R conc. are manufactured by Sumitomo Kagaku Kogyo Co., Ltd., and the remaining dyes are manufactured by Nippon Kayaku Co., Ltd.

EXPERIMENT 2

Various embodying samples and comparison samples of dye liquors were prepared by using a direct dye, Kayaku direct special black AXN, and an acid dye, Kayanol milling black TLB, in such a manner that each of the dye liquors was made into five types by adding silica gel G thereto in amounts of 5, 7, 10 and 20% OWF and without the addition of silica gel. These samples were each used for dyeing a piece of white cloth (Multifiber test fabric No. A) made of the various kinds of fibers listed in the following Table 2 as embodying examples and comparison examples as explained in detail below. Using each of the dye liquor samples, the white cloth was subjected to a dyeing treatment in such a manner that the same was dipped, at a normal temperature, in the dye liquor which was 5% OWF in dye concentration and in a bath ratio of 1:100 and thereafter the resultant dye bath was raised in temperature to 97°-99° C. during a period of 20-30 minutes. This temperature was maintained for 60 minutes.

The cloth after the dyeing treatment was fully washed with hot water of 45°-50° C., and was then air dried.

Thereafter, the L* value (Luminosity) of each of the dyed cloths was measured by direct-reading of a colorimeter (Suga testing machine SM-3-SCH type). There were obtained the measured values as indicated in the following Table 2.

TABLE 2

| Kind of dye and concentration | Silica gel G concentration | L* value of dyed cloth | | | | | |
|---|---|---|---|---|---|---|---|
| | | Cotton | Nylon | Vinylon | Wool | Rayon | Silk |
| | 0 | 40.60 | | 30.94 | 28.22 | 38.51 | 33.99 |
| Kayaku direct special black AXN 5% OWF | 5% OWF | 34.51 | | 28.59 | 26.45 | 31.78 | 29.17 |
| | 7% OWF | 34.29 | | 28.35 | 25.49 | 31.20 | 28.14 |
| | 10% OWF | 32.71 | | 27.62 | 24.99 | 29.93 | 29.25 |
| | 20% OWF | 30.81 | | 27.67 | 23.93 | 26.65 | 27.25 |
| Kayanol milling black TLB 5% OWF | 0 | | 35.83 | | 27.59 | | 35.31 |
| | 5% OWF | | 34.78 | | 27.01 | | 30.72 |
| | 7% OWF | | 34.60 | | 26.53 | | 30.72 |
| | 10% OWF | | 34.31 | | 26.01 | | 30.67 |
| | 20% OWF | | 32.38 | | 25.82 | | 29.96 |

As will be clear from the Table 2, in the case of each embodying example wherein the silica gel G is added to the dye liquor the L* value is lower than that in the case of each comparison example. Also, in respect of all of the fibers listed in the Table, all of the cloths are dyed at a high degree of exhaustion.

EXPERIMENT 3

Various dye liquors of the acid dye Suminol milling black VLG listed in the following Table 3 were prepared by the addition of silica gel G in the amounts shown, and without the addition of silica gel. These dye liquors were each used for dyeing a piece of refined silk cloth (called "Hira (or plain) habutae" 21 metsuke), as embodying examples and comparison examples as explained in detail below. The dyeing concentration, the bath ratio and the dyeing temperature were substantially the same as those in EXPERIMENT 2.

The silk cloth after being treated was fully washed with hot water, and was then air dried.

Thereafter, the pH value of the residual bath of each dye liquor and L* value of each cloth were measured, and a color-fastness of light test, a color-fastness to washing (laundry) test and a color-fastness to rubbing test were carried out in accordance wih JIS-L-0842, JIS L-0844, JIS L-0849. The rubbing test comprises the following steps:

(1) cutting the dyed silk cloth to the size of about 22 cm×3 cm;

(2) wrapping with a dried or wet piece of rubbing test-use white cotton cloth the top end portion of the rubbing member of a II-type rubbing test machine;

(3) fixing to a test rack of the test machine a test-piece of the dyed silk cloth prepared as instructed in step (1);

(4) moving the rubbing member wrapped with a dried or wet piece of the rubbing test-use white cotton cloth back and forth on the surface of the test-piece fixed to the test rack for 100 times to rub the test-piece therewith;

(5) determining how much of the dried or wet piece of white cotton cloth has become stained with the color by the rubbing through comparison with the Standard Gray Scale for Plate Staining; and (6) noting which of the five grades of the Gray Scale is indicated, with Grade 1 indicating the greatest stain and the poorest fastness and Grade 5 indicating the least stain and the best fastness. There were obtained the measured values indicated in the following Table 3.

TABLE 3

| Dyeing process | Embodying example 1 | Embodying example 2 | Comparison example 1 | Comparison example 2 |
|---|---|---|---|---|
| Refined silk cloth | 47.1 g | 46.3 g | 45.7 g | 46.1 g |
| Suminol milling black VLG | 2.83 g | 2.78 g | 2.74 g | 2.77 g |
| silica gel G | 9.42 g | 3.24 g | — | — |
| Ammonium acetate | — | 2.32 g | 2.29 g | 2.31 g |
| Glacial acetic acid | — | 0.69 g | 0.69 g | 1.72. g |
| Overall bath amount | 4,710 ml | 4,630 ml | 4,570 ml | 4,610 ml |
| Residual bath PH after dyeing | 6.43 | 5.38 | 5.45 | 4.93 |
| L* value of dyed cloth | 16.03 | 16.01 | 16.67 | 16.68 |
| Color fastness to light | 6 grade | 6 grade | 3 grade | 5 grade |
| Washing | | | | |
| Color fading | 4-5 grade | 4-5 grade | 3-4 grade | 4-5 grade |
| Staining 3-4 grade (Silk) | 4 grade | 4 grade | 4 grade | |
| Staining (Cotton) | 4-5 grade | 5 grade | 5 grade | 5 grade |
| Rubbing | | | | |
| Dried | 2 grade | 2-3 grade | 3-4 grade | 3-4 grade |

TABLE 3-continued

| Dyeing process | Embodying example 1 | Embodying example 2 | Comparison example 1 | Comparison example 2 |
|---|---|---|---|---|
| Wet | 4 grade | 4 grade | 4–5 grade | 4–5 grade |

As will be clear from Table 3, in the case of the embodying examples having the silica gel G added to the dye liquor, even if it is a neutral bath dyeing process, the L* value is smaller than that in the case of each comparison example which is an acid bath dyeing process. Accordingly, the cloth can be dyed deeply. In addition, the color fastness of each embodying example is equal to or more than that of each comparison example. Additionally, if observed directly, it has been confirmed that in the case of each embodying example, the cloth is dyed a deeper black than in the case of each comparison example.

EXPERIEMENT 4

Embodying samples and a comparison sample were prepared by using dye liquors of the direct dye, Kayaku direct special black AXN, instead of the acid dye used in the foregoing EXPERIMENT 3. The dye liquors were made into the embodying samples of adding silica gel G in the amounts shown. The comparison example had no added silica gel G.

The samples were each used for dyeing a refined silk cloth ("Hira Habutae 21 Metsuke"), and a dyeing treatment was carried out substantially in the same manner as was done in the foregoing EXPERIMENT 3.

After the dyeing treatment each dyed cloth was washed with water and air dried, and then the pH value of the residual bath and the reflectivity, or reflectance, of each silk cloth were measured, and a color fastness to light test, a color fastness to washing test and a color fastness to perspiration (sweat) test were carried out according to JIS L-0844, JIS L-0848 and JIS L-0848. The perspiration test comprises that following steps:

(1) sandwiching a 6 cm×6 cm piece of dyed silk cloth between piece of white cotton cloth and a piece of white silk cloth and sewing the pieces along one side to make a composite test-piece;
(2) preparing an artificial sweat, either of the acid type or of the alkaline type;
(3) placing the test-piece in the artificial sweat for 30 minutes at room temperature;
(4) removing the test-piece from the sweat and ringing it out between two glass rods;
(5) sandwichingthe test-piece between two plates of hard plastic and placing the test-piece and the plates in a perspiration test machine under a pressure of 4 kgs.;
(6) putting the perspiration test-machine in a dryer at a temperature of plus or minus 37 C. for four hours;
(7) removing the test-piece from the perspiration test machine, separating the dyed silk cloth from the other pieces and air-drying it; and
(8) measuring the degree of discoloration by comparison with the Gray Scale as discussed above in connection with the rubbing test.

The results of measuring the reflectance thereof are shown in FIG. 1 as reflectivity characteristic curves. In this figure, curves A, B and C are respective reflectivity curves of the dyed cloths obtained by the Embodying example 1, the Embodying example 2 and the Comparison example, respectively. The other measured values and the test results are shown in Table 4.

As will be clear from the reflectivity curves in FIG. 1, in the case of the embodying examples in which the dye liquors have silica gel G added thereto, the reflectivity is lower than the comparison example in which there was no added silica gel G, over the entire range of the visible light region. Accordingly it was confirmed that the color of the dyed cloth obtained in each embodying example is black and very close to pure black. In addition, it was quite obvious from an observation of the dyed cloths that the color depth decreased in the following order: Embodying example 1, Embodying example 2 and the Comparison example. Further, as will be clear from Table 4, the color fastness of the dyed cloths obtained by the embodying examples was not inferior to that obtained by the comparison example, and furthermore, the color fastness to light was excellent.

TABLE 4

| Dyeing process | Embodying example 1 | Embodying example 2 | Comparison example |
|---|---|---|---|
| Refined silk cloth | 46.2 g | 47.1 g | 46.3 g |
| Kayaku direct special black AXN | 2.77 g | 2.83 g | 2.78 g |
| Silica gel G | 9.24 g | 3.30 g | — |
| Glauber's salt anhydride | — | 14.1 g | 13.9 g |
| Overall bath amount | 4,620 ml | 4,710 ml | 4,630 ml |
| Residual bath PH after dyeing | 7.58 | 6.85 | 6.78 |
| L* value of dyed cloth | 6.18 | 17.05 | 17.91 |
| Color fastness to light | 5 grade | 3 grade | 1 grade |
| Washing | | | |
| Color fading | 4–5 grade | 3–4 grade | 3–4 grade |
| Staining (Silk) | 3–4 grade | 3–4 grade | 3–4 grade |
| Staining (Cotton) | 1 grade | 1–2 grade | 2 grade |
| Acidic perspiration | | | |
| Color fading | 4–5 grade | 4–5 grade | 4–5 grade |
| Staining (Silk) | 4 grade | 4–5 grade | 4–5 grade |
| Staining (Cotton) | 4–5 grade | 4–5 grade | 4–5 grade |
| Alkaline perspiration | | | |
| Color fading | 4–5 grade | 4–5 grade | 4–5 grade |
| Staining (Silk) | 3–4 grade | 4 grade | 4 grade |
| Staining (Cotton) | 2 grade | 2–3 grade | 3–4 grade |
| Rubbing | | | |
| Dried | 2 grade | 2–3 grade | 3 grade |
| Wet | 3 grade | 4 grade | 4 grade |

EXPERIMENT 5

A hank dyeing machine for sprayjet type 2-cylinders, which is known as a practical dyeing machine, was used, and single silk yarns were dyed using an an embodying sample, a dye liquor of Kayanol milling black TLB having silica gel G added thereto, and as a comparison sample, the same liquor not having any added silica gel G. The dyeing concentration, the bath ratio and the dyeing temperature were the same as those in the foregoing EXPERIMENT 2. The single silk yarns after the dyeing treatment were washed with hot water, three times, in the hank dyeing machine, and thereafter the same were dehydrated and air dried. Thereafter, the pH value of the residual bath of the dye liquor was measured and each of the dyed single silk yarns was decolored by a 50% pyridine solution, and the absorption factor of the decoloring liquor was measured to obtain absorption factor curves shown in FIG. 2. The curves D and E denote absorption factor curves of the Embodying example and the Comparison example, respectively.

TABLE 5

| Dyeing process | Embodying example | Comparison example |
|---|---|---|
| Single silk yarn | 623.6 g | 575.3 g |
| Kayanol milling black TLB | 62.4 g | 57.5 g |
| Silica gel G | 43.7 g | — |
| Ammonium acetate | 20.0 g | 17.3 g |
| Glacial Acetic acid | 9.4 g | 8.6 g |
| Overall bath amount | 62.4 l | 57.5 l |
| Residual bath pH after dyeing | 6.99 | 6.12 |

Figure 2:
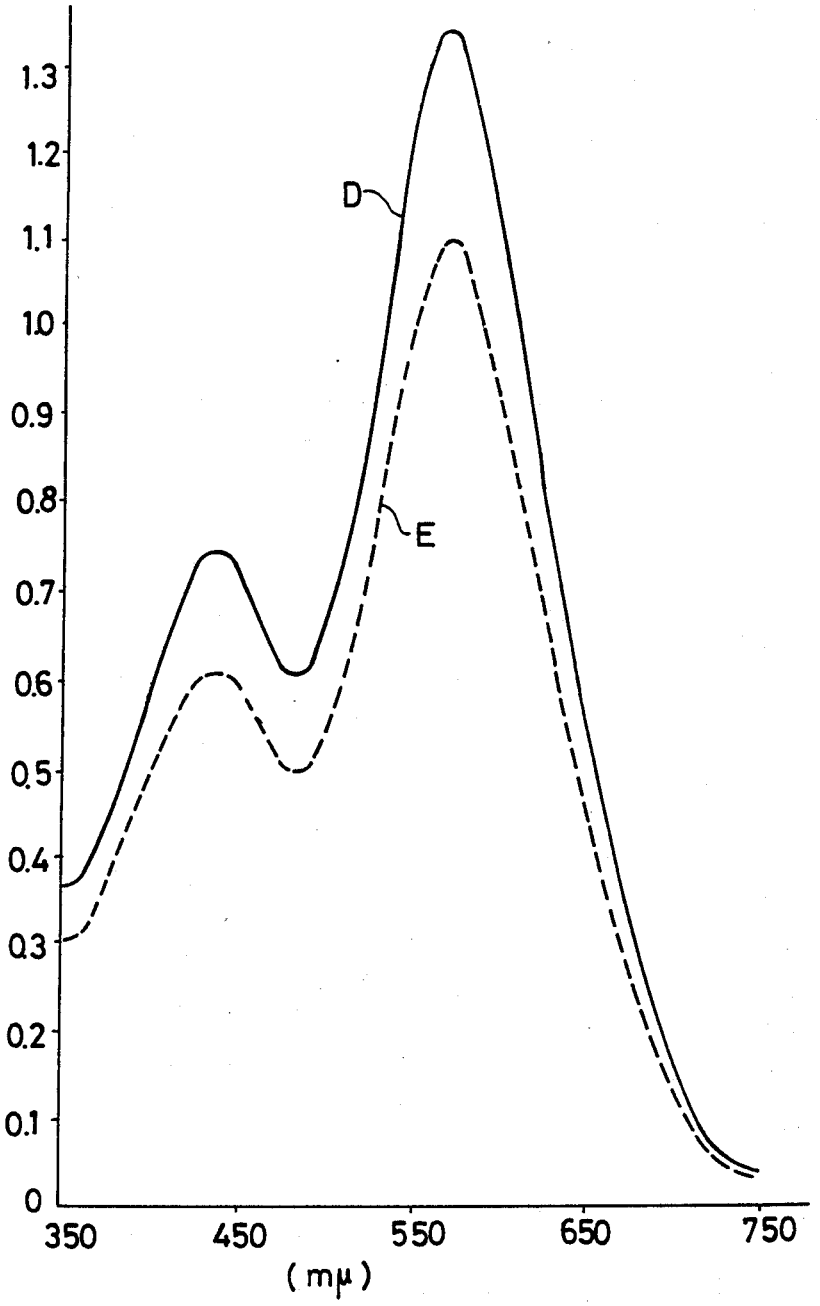
FIG. 2 is a characteristic curve diagram showing absorption factors of decoloring liquids used for decoloring silk yarns dyed according to an embodying example of the dyeing process of this invention and according to a comparison example thereof.

As will be clear from the absorption factor, or absorptance curves, D, A shown in FIG. 2, the silk yarn dyed according to the embodying example is larger in absorption amount of dye than the yarn dyed according to the comparison example. When observed directly, it was confirmed that the silk yarn dyed according to the embodying example is deeper and the dyed silk yarn itself was given a voluminous feeling in appearance.

Thus, according to the present invention, by adding granules of silica gel to a dye liquor, there can be achieved an improvement in the degree of exhaustion in respect of various kinds of fibers, and a degree of exhaustion which is higher than that in a conventional acid bath dyeing process can be obtained even in a neutral bath dyeing process. Accordingly, a hyperchromic dyeing excellent in leveling property can be carried out, and a color fastness nearly equal to that obtained by the conventional acid bath dyeing process can be obtained.

What is claimed is:

1. A process for dyeing silk, wool, nylon, cotton, rayon or polyvinyl alcohol fibers comprising contacting the fibers to be dyed with a dye in a dye liquor containing granules of silica gel, wherein the silica gel granules have a diameter in the range of 3 to 40 micrometers and wherein the dye is one that comes dye anions in a dye liquor.

2. The process of claim 1 wherein the amount of granules of silica gel in the dye liquor is 5–10% by weight based on the weight of the fiber.

3. The process of claim 1 wherein the bath ratio between the fiber and the dye liquor is 1:50–1:100.

4. The process of claim 1, wherein the silica gel granules have a diameter in the range of 10 to 40 micrometers.

* * * * *

UNITED STATES PATENT AND TRADEMARK OFFICE

CERTIFICATE OF CORRECTION

PATENT NO. : 4,891,047

DATED : January 2, 1990

INVENTOR(S) : KATO et al

It is certified that error appears in the above-identified patent and that said Letters Patent is hereby corrected as shown below:

On the cover page, after Item [76], the following should be inserted:

--[73] Asignee: Director-General of the Sericultural Experiment Station, Ministry of Agriculture, Forestry and Fisheries of Japan, Ibaraki, Japan--.

On the cover page, Item [76], "Hrioshi Kato" should read --Hiroshi Kato--.

Signed and Sealed this

Nineteenth Day of February, 1991

*Attest:*

HARRY F. MANBECK, JR.

*Attesting Officer*

*Commissioner of Patents and Trademarks*